United States Patent [19]

Rasmussen et al.

[11] 3,944,211

[45] Mar. 16, 1976

[54] LETTER FEEDER

[75] Inventors: Donald C. Rasmussen, Barrington, Ill.; Richard L. Funkhouser, St. Petersburg, Fla.

[73] Assignee: NCR Corporation, Dayton, Ohio

[22] Filed: Feb. 27, 1975

[21] Appl. No.: 553,853

Related U.S. Application Data

[63] Continuation-in-part of Ser. No. 410,107, Oct. 26, 1973, abandoned.

[52] U.S. Cl. ..... 271/8 R; 271/34; 271/122; 271/245

[51] Int. Cl.[2] ..... B65H 5/02

[58] Field of Search ..... 271/122, 124, 125, 34, 271/35, 172, 2, 245, 246, 229, 230, 8 R; 198/DIG. 16

[56] References Cited

UNITED STATES PATENTS

| | | | |
|---|---|---|---|
| 629,348 | 7/1899 | Fischer | 271/122 X |
| 2,995,362 | 8/1961 | Levy | 271/122 |
| 3,339,917 | 9/1967 | Petrovsky | 271/122 |
| 3,347,348 | 10/1967 | Flint et al. | 271/2 X |
| 3,537,703 | 11/1970 | Blow | 271/172 X |

*Primary Examiner*—Evon C. Blunk
*Assistant Examiner*—Bruce H. Stoner, Jr.
*Attorney, Agent, or Firm*—J. T. Cavender; Wilbert Hawk, Jr.; Richard W. Lavin

[57] ABSTRACT

A letter feeder including a pair of belts mounted perpendicular to each other for transporting letters positioned thereon, a rotating brush roller and a control assembly both selectively movable to a position to stop a letter being transported by the belts and to separate double letters a selectively operated stop member for controlling the movement of letters from the feeder and a plurality of sensing members for selectively operating the brush roller, the control assembly and the stop member.

6 Claims, 5 Drawing Figures

LETTER FEEDER

CROSS-REFERENCE TO RELATED APPLICATION

The application is a continuation-in-part of U.S. Pat. application Ser. No. 410,107 filed on Oct. 26, 1973 now abandoned by Donald C. Rasmussen and Richard L. Funkhouser, which application is assigned to the assignee of the present application.

BACKGROUND OF THE INVENTION

The present invention is directed to a secondary feeder mechanism for use in a mail coding system in which each piece of mail is encoded with a bar code signifying its destination so that the letter can be machine sorted for delivery. Included in the system is an encoding desk at which an operator will view each piece of mail and encode the address on the letter by means of a keyboard located at the coding desk. In order to provide maximum efficiency of operation, the coding desk must be continuously supplied with letters to be encoded. In present operations utilizing conventional mail feeders for feeding letters directly to the coding desk, problems have developed in which gaps have occurred in the stream of letters arriving at the coding desk in addition to doubles, that is, one letter stacked behind another letter, thereby preventing the operator from seeing the back letter. Both of these problems prevent the system from operating at an economically feasible rate. Therefore, it is an object of this invention to provide a feeder apparatus which will eliminate the double feed of letters in addition to allowing the letters to be selectively fed to an operating station. Another object of the invention is to provide a feeder apparatus which will level the mail pieces during transporting by said feeder apparatus. It is a further object of this invention to provide a feed mechanism for performing the above-cited function which is simple in operation and structure and therefore low in cost.

SUMMARY OF THE INVENTION

In order to carry out these objects, there is disclosed a selectively operated secondary feeder mechanism including a pair of letter pickup belts mounted perpendicular to each other for supporting and transporting letters through the secondary feeder mechanism, a rotating brush roller and a control assembly both rotatably disposed adjacent the pickup belts for stopping and holding letters on the pickup belts and a movable stop member for releasing the letter for movement to a following station. The brush roller, control assembly and the stop member are selectively operable to be moved into engagement with the letters to separate double letters and to sequentially feed the separated letters to the following station.

DETAILED DESCRIPTION OF THE PREFERRED EMBODIMENT

Figure 1:
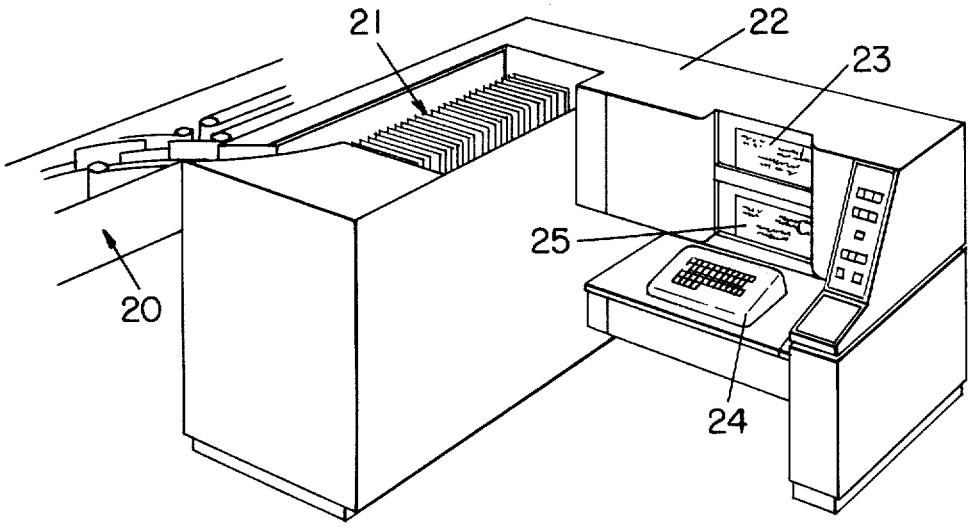
FIG. 1 is a pictorial view of the coding desk showing the viewing stations and the keyboard used to encode data on each mail piece.

Referring to FIG. 1, there is shown a view of the coding desk in which the present invention is incorporated. In normal operation, letters will be transmitted by an entry conveyor 20 to a buffer feeder 21 where they are stored until transported by a primary feeder apparatus (not shown) to the secondary feeder of the present embodiment both located in the main console 22 of the coding desk. Upon demand by the operator, the letter will be transported from the secondary feeder to a preview window 23. When the operator is clear to operate the keyboard 24, the letter will drop into a view window 25 where the operator will key in the appropriate data read from the letter on the keyboard 24. The letter will then be transported past a printer (not shown) where the information is printed in bar code on the letter and then to a following station.

Figure 3:
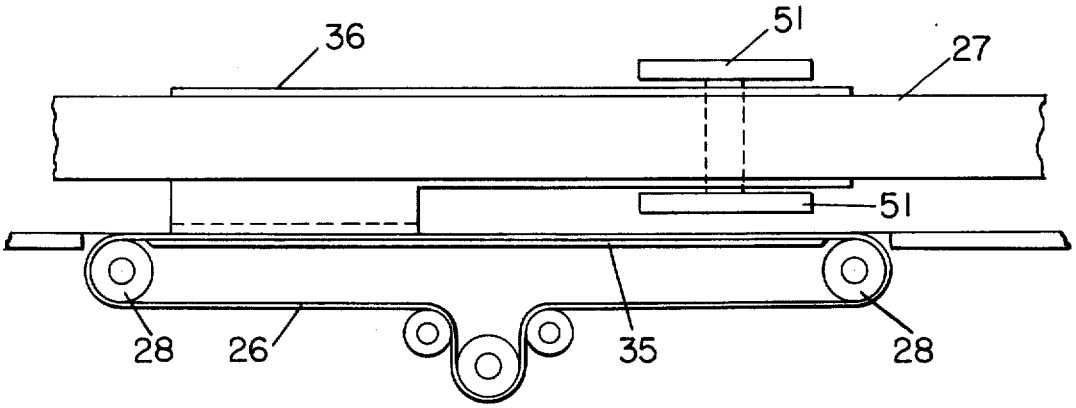
FIG. 3 is a partial side view of the vertical pickup belt showing the position of the fingers of the control assembly with respect to the vertical pickup belt and the backing plate.
Figure 2:
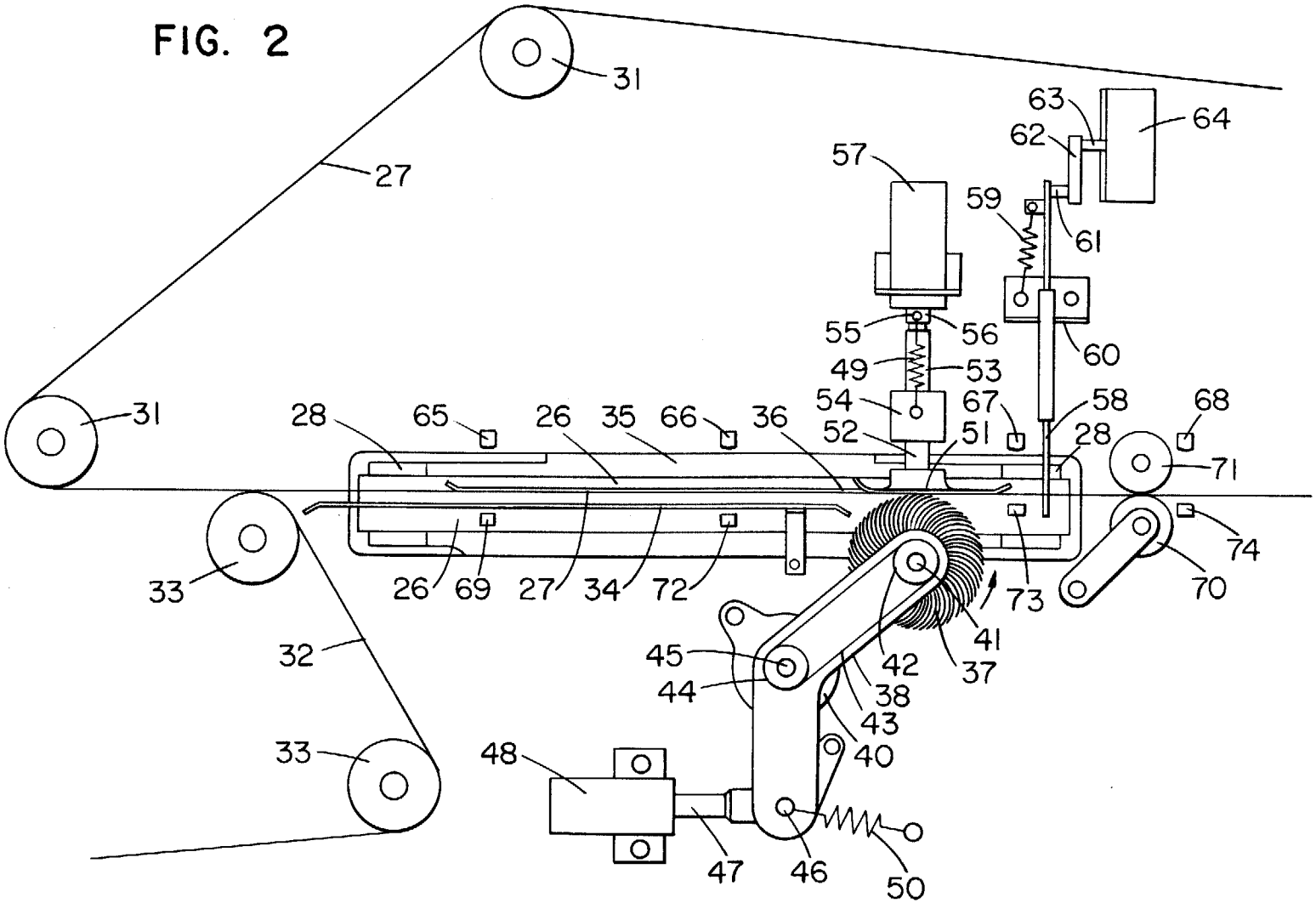
FIG. 2 is a top elevational view of a preferred embodiment of this invention as related to leveling, selective feeding and double removal of mail pieces.

Referring to FIG. 2, there is shown a top view of the secondary feeder mechanism which includes a pair of constantly moving transport belts 26, 27. The bottom horizontal belt 26 and the vertical face belt 27 (FIG. 3) are mounted perpendicular to each other and both run continuously at 100 inches per second. Both belts have a friction surface on one side and a non-friction surface on the other side and are composed of a non-static material to reduce the build-up of static charges on the mail pieces.

The belt 26 is mounted on rollers 28 (FIG. 2 and 3) while the belt 27 is transported by rollers 31, the belt 27 coacting with a belt 32 to transport mail pieces from the buffer feeder 21 (FIG. 1). The belt 32 is mounted on rollers 33. Mounted adjacent the belt 27 is a guide plate 34 for guiding the letter through the feed apparatus while positioned beneath the belt 26 is a backing plate 35 for supporting the belt in the horizontal plane. A backing plate 36 is also mounted adjacent the vertical belt 27.

Positioned adjacent the belt 27 is a constantly rotating brush 37 rotatably mounted on a support bracket 38 which in turn is rotatably mounted on a support member 40. The brush 37 is secured to a shaft 41 rotatably supported by the bracket 38 to which is also mounted a roller 42 engaged by a drive belt 43 which in turn is driven by a drive roller 44 secured to a drive shaft 45 extending through the bracket 38. The drive shaft 45 is driven by a motor (not shown) in a counter-clockwise direction thus rotating the brush in a like direction as indicated by the arrow in FIG. 2.

Secured to the other end of the bracket 38 is a rod 46 which is engaged by one end of the armature 47 of a solenoid 48. The rod 46 is also engaged by one end of a spring 50 which normally urges the bracket 38 and the brush 37 in a counter-clockwise direction as viewed in FIG. 2. Energizing of the solenoid 48 will rotate the bracket 38 in a clockwise direction thereby removing the brush 37 from engagement with the belt 27. Deenergizing of the solenoid 48 will allow the spring 50 to return the brush against the belt.

Mounted adjacent the belt 27 opposite the brush 37 is a control assembly comprising a pair of finger members 51 (FIGS. 2 and 3) positioned adjacent both the belt 27 and the guide plate 36. Both finger members 51 are secured to a bracket 52 which in turn is mounted on the end of shaft 53 slidably mounted on a support member 54. The other end of the shaft 53 is connected by a pin 55 to the armature 56 of a solenoid 57. Energizing of the solenoid 57 will move the fingers 51 away from the belt 27. Deenergizing of the solenoid 57 will allow a spring 49 (FIG. 2) mounted between the pin 55 and the support member 54 to return the fingers to the position shown in FIG. 2.

Mounted downstream of the fingers 51 is a rod 58 slidably mounted in a support member 60 and extending in a direction above the belt 27. The other end of the rod is secured to a pin 61 to which is rotatably mounted one end of a crank member 62. The other end of the crank member 62 is rotatably secured to the drive shaft 63 of a rotary solenoid 64. Energizing of the solenoid 64 will withdraw the rod from the pathway of the letter allowing the letter to advance. Deenergizing of the solenoid 64 will allow a spring 59 (FIG. 2) to move the rod to a position blocking the movement of the letter.

Figure 4:
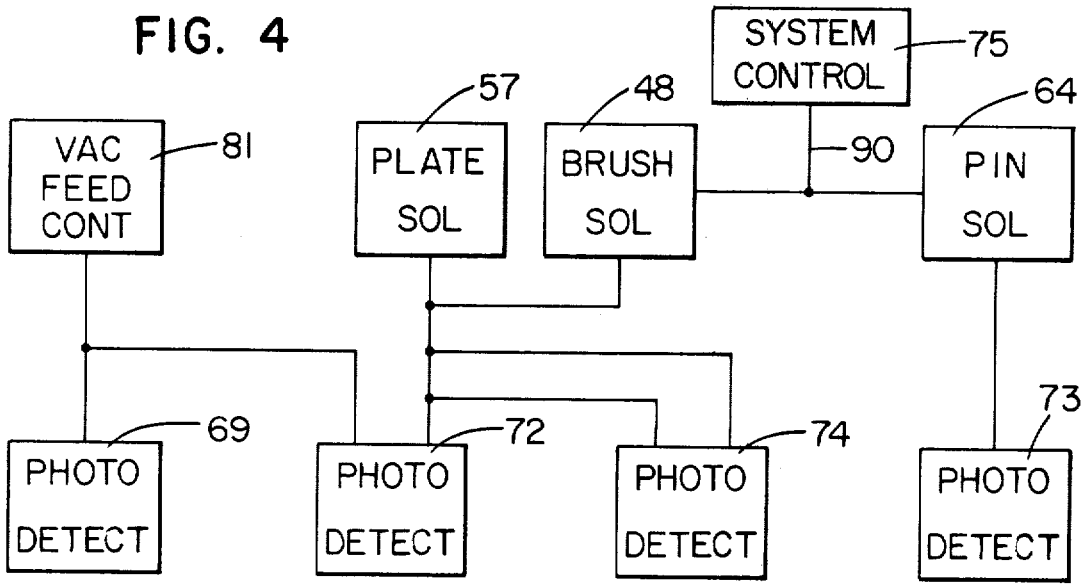
FIG. 4 is a block diagram of the electrical control circuit used to control the solenoids of the present invention.
Figure 5:
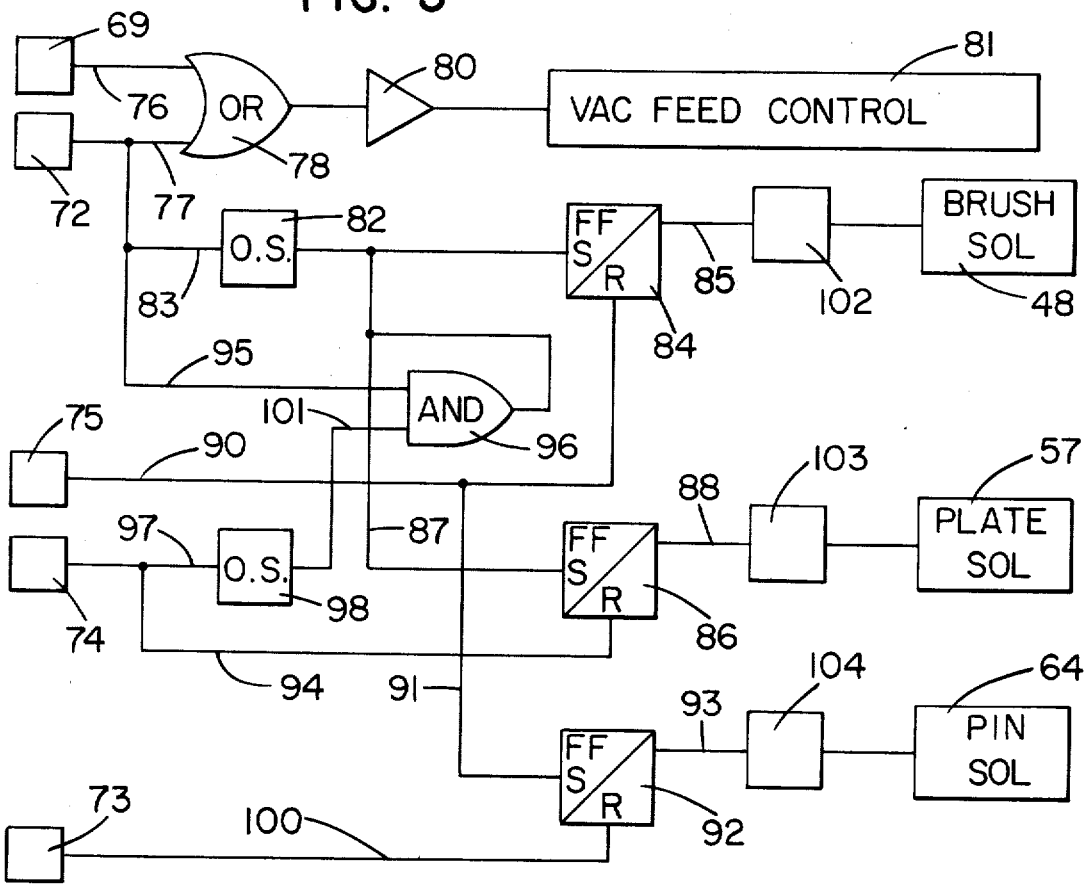
FIG. 5 is a schematic diagram of the control circuit of FIG. 4.

Positioned adjacent the belts 26, 27 are a plurality of light sources 65, 66, 67, 68 which are used in sensing the position of letters on the belts 26, 27. The light sources 65–68, inclusive, operate with associated photo-detectors 69, 72, 73 and 74, respectively, to control the solenoids 48, 57, and 64 as shown in FIGS. 4 and 5. The light sources 65–68, inclusive, may be lamp or light-emitting-diodes, while the photo-detectors may include photo-transistors which generate a signal level according to the light intensity received from its associated light source in a manner which is well known in the art. Thus, when a letter intercepts the light path of one of the light sources 65–68, inclusive, the photo-detector associated with the light source will generate a first control signal, which will control the energizing or deenergizing of an associated solenoid. Where the light path is not intercepted by a letter, the photo-detector will generate a second control signal which will control associated solenoids in accordance with the description of the circuit of FIG. 5.

Referring now to FIG. 4, there is shown a block diagram of the electrical control circuit used to control the operation of the various control solenoids. As shown in FIG. 4 and FIG. 2, the control signals from the photo-detectors 69 and 72 are used to signal the presence or absence of a letter adjacent the guide plate 34 which constitutes the secondary feeder storage area. Control signals from photo-detectors 72 and 74 will control the energizing and deenergizing of the plate solenoid 57 and the brush solenoid 48, while a control signal from photo-detector 73 will control the energizing and deenergizing of the pin solenoid 64. A feed signal from system control 75 will also control the operation of the brush solenoid 48 and the pin solenoid 64.

There will now be described an operation of the secondary feeder. As described previously, letters will be transported by the conveyor 20 (FIG. 1) to the input buffer 21. From the buffer, each of the letters will be transported by the belts 27, 32 onto the horizontal belt 26 (FIGS. 2 and 3), the letters being held by the belt 27 against the guide plate 34. At this time both the fingers 51 of the control assembly and the rotating brush 37 are in an engaging position since their respective solenoids 57, 48 are in a deenergized state. The transporting of the letters to the secondary feeder from the input buffer 21 are controlled by the photo-detectors 69, 72 (FIGS. 2 and 5). When no letter is in the secondary feeder, the photo-detectors 69 and 72 will each generate a first output control signal as a result of receiving directed light from their associated light sources 65 and 66, respectively. The first output control signals from the photo-detectors 69 and 72 are fed over lines 76, 77 to the inputs of the OR gate 78. The gated output signal from OR gate 78 is fed to the input of an amplifier 80, the output of which provides a control signal to a vacuum feed control 81, resulting in the operation of a feed mechanism which positions a letter from the buffer 21 on the belts 27, 32 which transport the letter to the horizontal belt 26. The use of the horizontal belt 26 to transport the letter will also level the letter as it is being moved to the brush 37 and the fingers 51. If no letter is received by the secondary feeder after a prescribed time interval, a second letter will be sent to the secondary feeder. Thus, there will always be a letter in the secondary feeder for movement to the preview window.

As the letter is being moved by the belt 26 into engagement with the brush 37 and the fingers 51, the letter will intercept the directed light from the light sources 65, 66, thus causing the photo-detectors 69 and 72 to each produce a second output control signal over lines 76 and 77. These second output control signals will produce a gated output from the OR gate 78 through the amplifier 80 to the vacuum feed control 81 which will disable the feeding of another letter to the secondary feeder. The second output signal from the photo-detector 72 will trigger a single-shot multivibrator 82 over line 83 whose output signal will be fed to the set input of a flip-flop 84. The output signal from the flip-flop 84 when in a set condition will be fed over line 85 to a driver 102 whose output signal will energize the brush solenoid 48. The output signal from the multivibrator 82 will also be fed to the set input of a flip-flop 86 over line 87 whose output signal over line 88 is fed to a driver 103 whose output will energize the plate solenoid 57. The single-shot multivibrator 82 used in the present application is activated by a significant transition of the input signal. The shape, duration and polarity of the output signal are determined by the circuit characteristics of the multivibrator, not by the input signal. As is well known in the art, the output signal of the multivibrator is switched from one level to a second level when activated for the characteristic period of time determined by the circuit and then returned to the first level.

The flip-flop devices used in this circuit can be of any conventional design where the output signal level is switched between two states by the application of a control signal to the Set and Reset inputs. In the present application, the triggered output signal from the single shot multivibrator 82 will flip the flip-flops 84 and 86 to a set condition wherein the output signals will result in the energizing of the plate solenoid 57 and the brush solenoid 48.

The energizing of the solenoids 48, 57 will withdraw the fingers 51 and the brush 57 from engagement with the letter allowing the belt 26 to move the letter forward until it is stopped by the pin 58. As the letter moves into engagement with the pin 58, it will block the light source 67 resulting in the photo-detector 73 generating a signal to the reset input of a flip-flop 92. Since the flip-flop 92 is in a reset condition at the present time, the pin 58 will remain in a blocking position. When a feed signal is generated over line 90 (FIG. 5)

from the system control 75 indicating that a letter is to be sent to the preview window, the signal will be fed to the reset input of the flip-flop 84, thereby resetting the flip-flop whose output signal over line 85 to the driver 102 will result in the deenergizing of the brush solenoid 48 which allows the spring 50 (FIG. 2) to move the brush 37 into engagement with the letter. The feed signal over line 90 is also fed over line 91 to the set input of the flip-flop 92 setting the flip-flop whose output signal over line 93 to the driver 104 will result in the energizing of the solenoid 64 (FIG. 2). Energizing of the solenoid 64 will result in the withdrawing of the pin 58 from a blocking position with respect to the letter. Because the friction between the letter and the vertical feed belt 27 is greater than the friction between the brush 37 and the letter, the belt 27 will move the letter past the pin 58 and into engagement with a pair of rollers 70, 71 (FIG. 2) which feeds the letter to the preview window 23 (FIG. 1).

As the letter moves through the pinch rollers 70, 71 two conditions will occur. The letter will first block the light source 68 (FIG. 2), thereby switching the output signal of photo-detector 74. As shown in FIG. 5, the switched output signal from the photo-detector 74 will be transmitted over line 94 to the reset input of flip-flop 86, thereby resetting the flip-flop resulting in the output signal of the flip-flop deenergizing the solenoid 57. The deenergizing of the solenoid 57 allows the spring 50 (FIG. 2) to move the fingers 51 into a blocking position with the brush 37. As the end of the letter clears the light source 67 (FIG. 2), photo-detector 73 will transmit a control signal over line 100 to the reset input of flip-flop 92, thereby resetting the flip-flop whose output signal will deenergize the solenoid 64 allowing the spring 59 (FIG. 2) to move the pin 58 to a blocking position.

If a double letter condition existed during this feed operation, the doubled letter which is against the rotating brush 37 will be moved back by the action of the brush since the friction between the letters is much less than the friction between the brush and the outer or doubled letter. This backward movement of the doubled letter will block the light sources 65 and 66 resulting in the photo-detector 72 generating a signal over line 95 to one input of an AND gate 96. Upon the first letter clearing the pinch rollers 70, 71 (FIG. 2), the photo-detector 74 will be switched to generate a trigger signal over line 97 to a one-shot multivibrator 98 which will generate a control signal over line 101 to the other input of the AND gate 96. The control signal from the multivibrator 98 is of the same state as the signal from the photo-detector 72 when in a blocking condition, thus turning on the AND gate 96 which gates a set control signal to the set inputs of flip-flops 84 and 86 during the time the multivibrator 98 is conducting. As described previously, this results in the energizing of the solenoids 48 and 57. The energizing of the solenoids 48 and 57 will withdraw the fingers 51 and the brush 37 allowing the doubled letter to be transported to the pin 53, thus resuming a normal feed cycle. If there was no double letter present, the photo-detector 74 would transmit a control signal over line 94 resetting the flip-flop 86, resulting in the deenergizing of the solenoid 57, thereby allowing the spring 49 (FIG. 2) to move the fingers 51 into engagement with the brush 37 to block the next letter that is transported from the input buffer 21 as described previously.

It will be seen by this structure that a single letter will always be in position for feeding to the preview window, thus insuring that all letters will be read by the operator at a rate limited by the operator rather than by the feed apparatus.

What is claimed is:

1. An apparatus for separating and feeding doubled letters to an operating station comprising a. means for transporting doubled letters in a straight line stream;

b. support means movably mounted adjacent the stream of doubled letters;

c. first urging means engaging said support means for normally urging said support means to engage the doubled letters in the stream;

d. a drive means rotating in a direction opposite to the direction of movement of the doubled letters and mounted for movement adjacent the stream of doubled letters;

e. second urging means engaging said drive means for normally urging said drive means to a position to engage said support means to block the movement of the doubled letters in the stream;

f. a movable stop member slidably mounted adjacent the stream of letters for movement between a blocking and non-blocking position with the letters in said stream when operated;

g. third urging means engaging said stop member for normally urging said stop means into a blocking position with the letters in said stream;

h. first actuating means engaging said support means for disengaging the support means from the drive means when operated whereby the drive means will separate the doubled letters allowing one of the letters to be moved to the stop member by said transporting means;

i. second actuating means engaging said drive means for disengaging the drive means from the separated letter when operated, whereby the separated letter is moved by said transporting means to the stop member;

j. third actuating means engaging said stop member for moving said stop member to a non-blocking position when operated whereby the letters blocked by stop members are moved to the operating station by said transporting means;

k. and sensing means positioned adjacent the stream of letters and operatively connected to said first, second and third actuating means, said sensing means operating said actuating means upon sensing letters in said stream whereby doubled letters are separated by said drive means and moved separately to the operating station by said transporting means.

2. The apparatus of claim 1 in which said transporting means includes a pair of moving belts mounted perpendicular to each other in a horizontal and vertical position and said support means comprises an assembly having a pair of fingers straddling the vertical positioned transport belt, said assembly slidably mounted for movement in a direction to engage the doubled letters in said stream whereby upon movement of said rotating drive means to a position engaging the fingers of said assembly, said fingers and rotating drive means will block the movement of the doubled letters by said belts.

3. An apparatus for selectively separating and feeding doubled letters to an operating station comprising a. means for transporting doubled letters in a straight line stream;

b. support means slidably mounted adjacent said transporting means for movement to a position engaging the doubled letters on said transporting means;

c. drive means rotating in a direction opposite to the direction of movement of said transporting means and mounted for movement adjacent said transporting means to a position engaging the doubled letters on said transporting means;

d. a stop member positioned adjacent said transporting means and slidably mounted for movement to a position blocking the movement of the doubled letters by said transporting means;

e. first means normally urging said support means to an engaging position with the doubled letters;

f. second means normally urging said drive means into engagement with said support means to block movement of doubled letters by said transporting means and to separate doubled letters stopped by said stop member;

g. third means normally urging said stop member to a blocking position;

h. first actuating means for moving said support means to a non-engaging position when operated;

i. second actuating means for moving said drive means to a non-engaging position when operated;

j. third actuating means for moving said stop member to a non-blocking position when operated;

k. first sensing means positioned adjacent said support means and said drive means for sensing the double letters stopped by the engagement of said support member and said drive means, said first sensing means operatively connected to said first and second actuating means to operate said means upon sensing a letter whereby the double letters are released for movement by said transporting means to a position engaging said stop member;

l. second sensing means positioned adjacent said stop member for sensing a letter stopped by said stop member, said second sensing means operatively connected to said third actuating means to operate said third actuating means upon sensing a letter to disengage the stop member from the letter whereby the letter will be transported to the operating station;

m. and third sensing means positioned downstream of said stop member for sensing a letter transported by said transporting means downstream of said stop member, said third sensing means operatively connected to said first and third actuating means to disable said first actuating means whereby said support member is moved by said first actuating means to a position blocking the separated double letter and to disable said third actuating means whereby said stop member is moved by said third urging means to a position blocking the movement of the separated doubled letter by said transporting means.

4. The apparatus of claim 3 in which said transporting means includes a pair of moving belts mounted perpendicular to each other in a horizontal and vertical position and said support means comprises an assembly having a pair of fingers straddling the vertical positioned transport belt, said assembly slidably mounted for movement in a direction to engage the doubled letters in said stream whereby upon movement of said rotating drive means to a position engaging the fingers of said assembly, said fingers and rotating drive means will block the movement of the doubled letters by said belts.

5. A method for separating and feeding doubled letters to a following station comprising a. transporting a plurality of letters in a straight line stream;

b. stopping the letters;

c. moving a brush member, rotating in a direction opposite to the movement of the letters, into engagement with the stopped letters to move a doubled letter upstream of said brush member;

d. transporting the other letter to the following station and the doubled letter back toward the brush member;

e. moving a support member into engagement with the rotating brush member to stop the doubled letter;

f. and removing the support and brush members from engagement with the doubled letter to release the letter for movement to the following station.

6. A method for intermittently separating and feeding doubled letters from a supply station to a following station comprising a. moving a plurality of letters from a supply station in a straight line stream;

b. moving a support member to a position adjacent one side of the path of movement of the letters;

c. moving a brush member, mounted on the other side of the path of movement of the letters and rotating in a direction opposite to the movement of the letters into engagement with said support member stopping the moving letters;

d. moving a blocking member into the stream of movement of the letters downstream of said support and brush members;

e. removing the brush and support member from engagement with the letters;

f. moving the letters into engagement with the blocking member;

g. moving the brush into engagement with the letters to move a doubled letter upstream of the other letter stopped by the blocking member;

h. removing the blocking member from engagement with the other letter;

i. transporting the other letter to the following station;

j. moving the support member into engagement with said brush member stopping the doubled letter;

k. and removing the support and brush members from engagement with the doubled letter to release the letter for movement to the following station.

* * * * *